US005136732A

United States Patent [19]

Andersson

[11] Patent Number: 5,136,732

[45] Date of Patent: Aug. 11, 1992

[54] COMMODE FLUSHING APPARATUS

[75] Inventor: Sven E. Andersson, Salt Lake City, Utah

[73] Assignee: Maurice Burton, Salt Lake City, Utah ; a part interest

[21] Appl. No.: 732,489

[22] Filed: Jul. 18, 1991

[51] Int. Cl.[5] ..... E03D 3/10

[52] U.S. Cl. ..... 4/354; 251/144

[58] Field of Search ..... 4/354, 361, 362, 378, 4/407, 415; 137/206, 209; 251/33, 41, 144

[56] References Cited

U.S. PATENT DOCUMENTS

| | | | |
|---|---|---|---|
| 2,966,044 | 12/1960 | Mitchell | 251/33 X |
| 3,605,125 | 9/1971 | Gibbs et al. | 4/361 |
| 4,060,857 | 12/1977 | Couton | 4/362 |
| 4,233,698 | 11/1980 | Martin | 4/354 |
| 4,584,726 | 4/1986 | Grills et al. | 4/378 |
| 4,955,921 | 9/1990 | Basile et al. | 4/354 |
| 4,984,311 | 1/1991 | Basile et al. | 4/354 |

*Primary Examiner*—Henry J. Recla
*Assistant Examiner*—Robert M. Fetsuga
*Attorney, Agent, or Firm*—Richard F. Bojanowski

[57] ABSTRACT

A pressurized flushing apparatus for commodes in which low volumes of pressurized water are used for flushing. The apparatus includes a pressurizeable tank having a closed water outlet. The tank is pressurized by the introduction of pressurized water into the tank until a pressure of between 8 and 25 psi is achieved. Within the tank is a bellows to which a plug is attached to one end for closing the water outlet. A restrictable open channel connects a pressure zone above the water in the tank with an internal chamber located within the bellows. The open channel is consticted by a needle valve which controls the rate at which the pressure within the pressure zone and the internal chamber are equalized. When the pressure within the internal chamber is reduced to ambient pressure, the bellows will collapse and withdraw the plug from the water outlet. When this occurs, the pressurized water within the tank will be forced out of the tank and into the toilet bowl. Fresh water will then be introduced and the bellows will expand at a rate controlled by the needle valve. When the bellows is fully expanded, the water outlet is closed and the tank is refilled with water. The commode is now ready for the next flushing sequence.

16 Claims, 5 Drawing Sheets

COMMODE FLUSHING APPARATUS

BACKGROUND OF THE INVENTION

1. Field of Invention

This invention relates generally to a pressurized flushing system and more particularly to a pressurized flushing system wherein reduced volumes of water are required for cleaning and emptying commodes 2. State of the Art Gravity type flush toilets have been in use for over 100 years. During the past sixty years, essentially every new residence contains at least one flush toilet. It has been estimated that the average American uses about 9,000 gallons per year of drinking water for flushing. This accounts for over one-third of domestic water consumption in the United States. Most gravity type commodes require 3½ to 7 gallons of water per flush. When water was considered to be an abundant commodity, very little thought was given to water conservation. During the past twenty years, numerous articles have been published urging the public to be more "conservative" in their use of drinking water. As a result, ultra-low-volume (ULV) toilets are now being required in new home construction, particularly in the western states where water is becoming a scarce commodity.

A recent article published by Consumer Reports in its July 1990 issue reported that there were about&ten ULV models currently available for home use. All of these systems utilize from about 1.0 to 1.9 gallons of water per flush. Most of these systems are of the gravity type. However, a few of those listed utilize a pressure type system.

There are a number of patents which disclose various types of pressurized flush systems. These include U.S. Pat. Nos. 769,525; 2,502,262; 3,553,739 and 3,813,701. All of the above patents utilize a reduced volume of water to achieve flushing. However, none of these patents utilize the principles, features and possess the advantages hereinbelow described in detail.

SUMMARY OF INVENTION

The flushing system of this invention includes a pressurizeable container having a water inlet, a water outlet and a releasable plug for discharging pressurized water into a toilet bowl. A preselected volume of pressurized water is introduced into the sealed container. The water contained within the tank establishes two zones; a winter zone ie. that portion of the tank filled with water and a pressure zone located above the level of o the water zone. Within &he pressure zone, an expandable and retractable bellows having an internal chamber is fixed at one of its ends to the top of the container. The other end of the bellows is securely attached to the releasable plug. A constrictable channel connects the pressure zone with the internal chamber so that a pressure equilibrium can be attained therebetween. A sudden loss of the internal chamber's pressure will cause the bellows to collapse and thereby raise the plug and open the water outlet. This forces the pressurized water through the outlet and into a toilet bowl connected thereto, creating a flushing action. After all of the water has been released and the toilet bowl has been refilled, the bellows expands and the plug attached thereto closes the water outlet. This permits pressurized water to again fill the container and the above sequence is repeated in preparation for the next flushing cycle.

DESCRIPTION OF THE PREFERRED EMBODIMENTS

Figure 2:
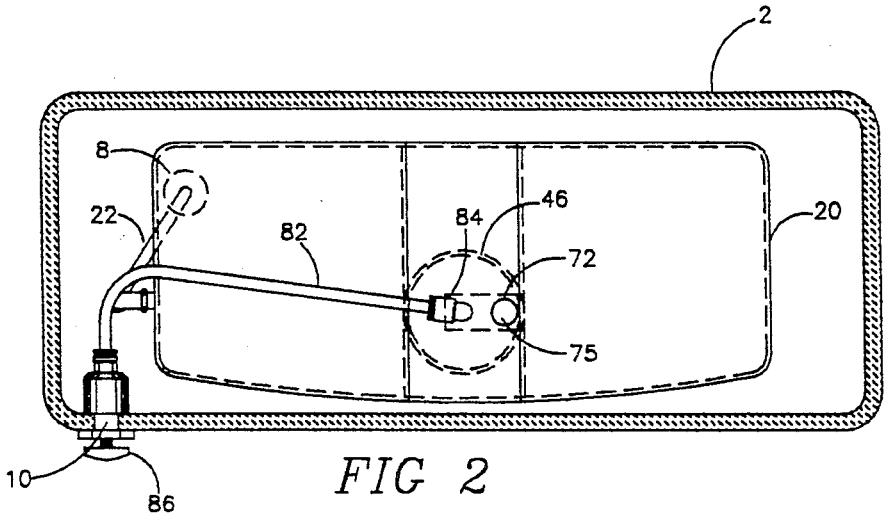
FIG. 2 is a top plan and part sectional view taken along line 2—2 of FIG. 1.
Figure 1:
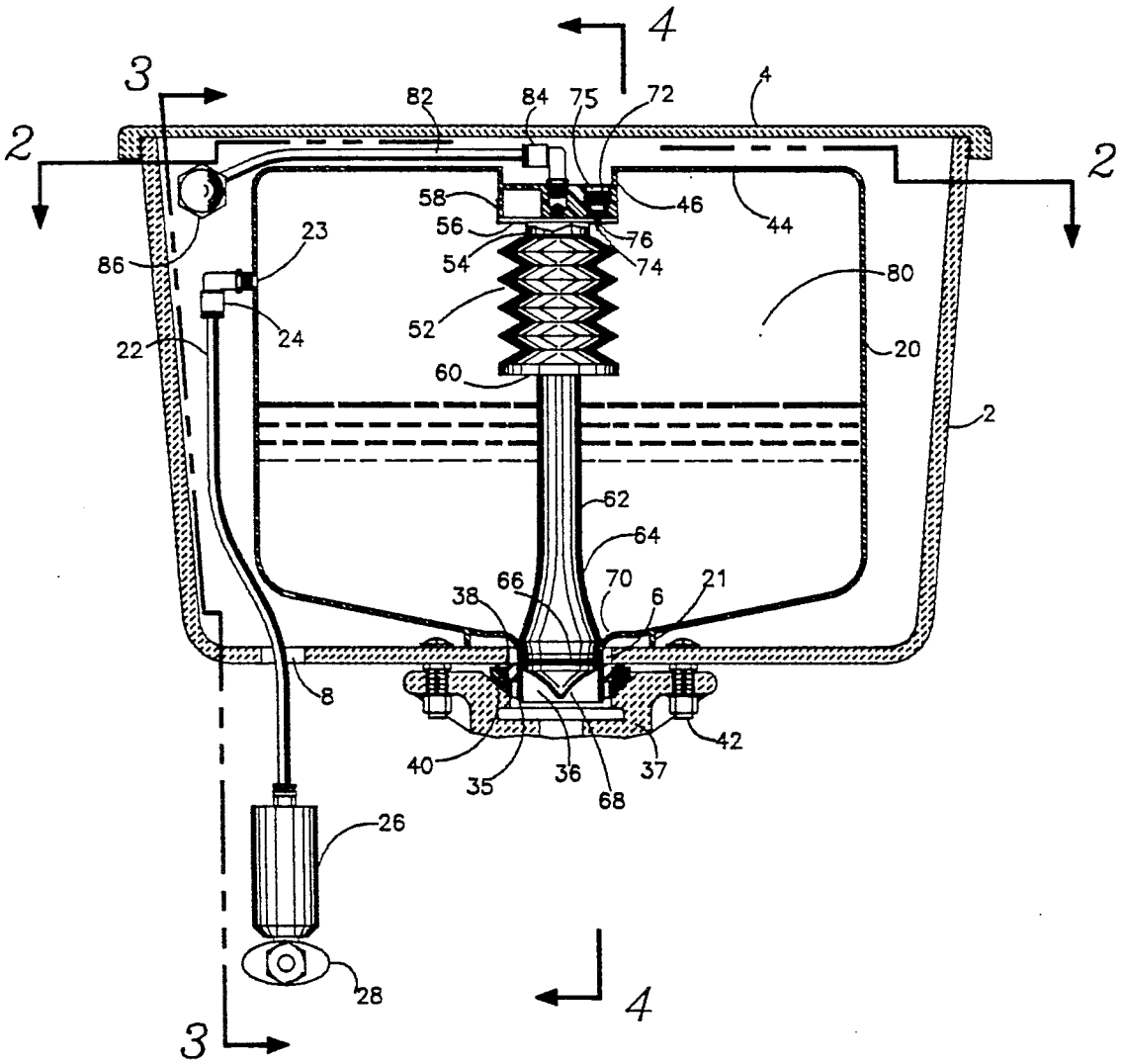
FIG. 1 is a partial cross sectional view and side elevation of the flushing system in its charged state.
Figure 3:
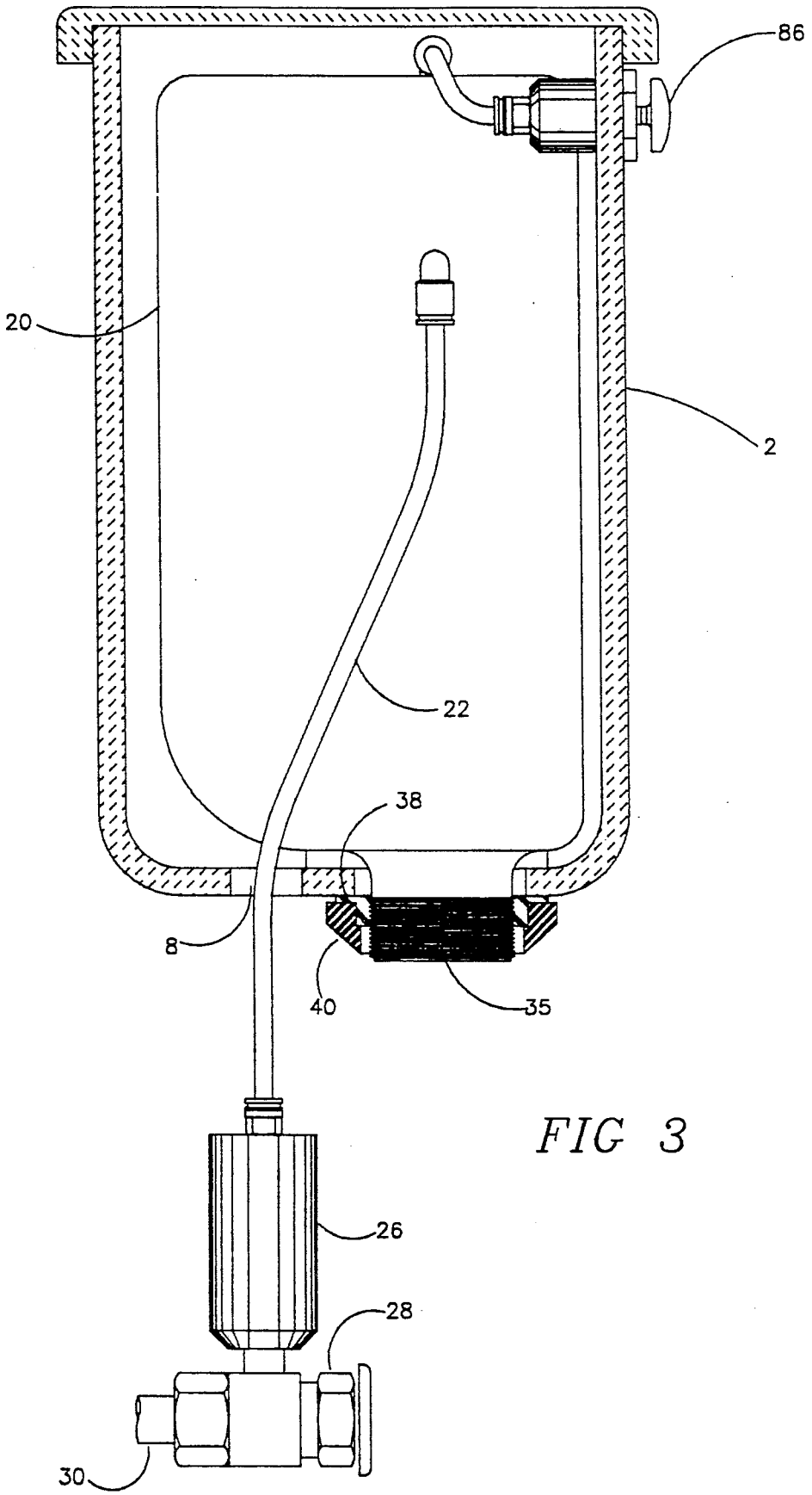
FIG. 3 is an enlarged side elevation and part cross sectional view taken along line 3—3 of FIG. 1.
Figure 4:
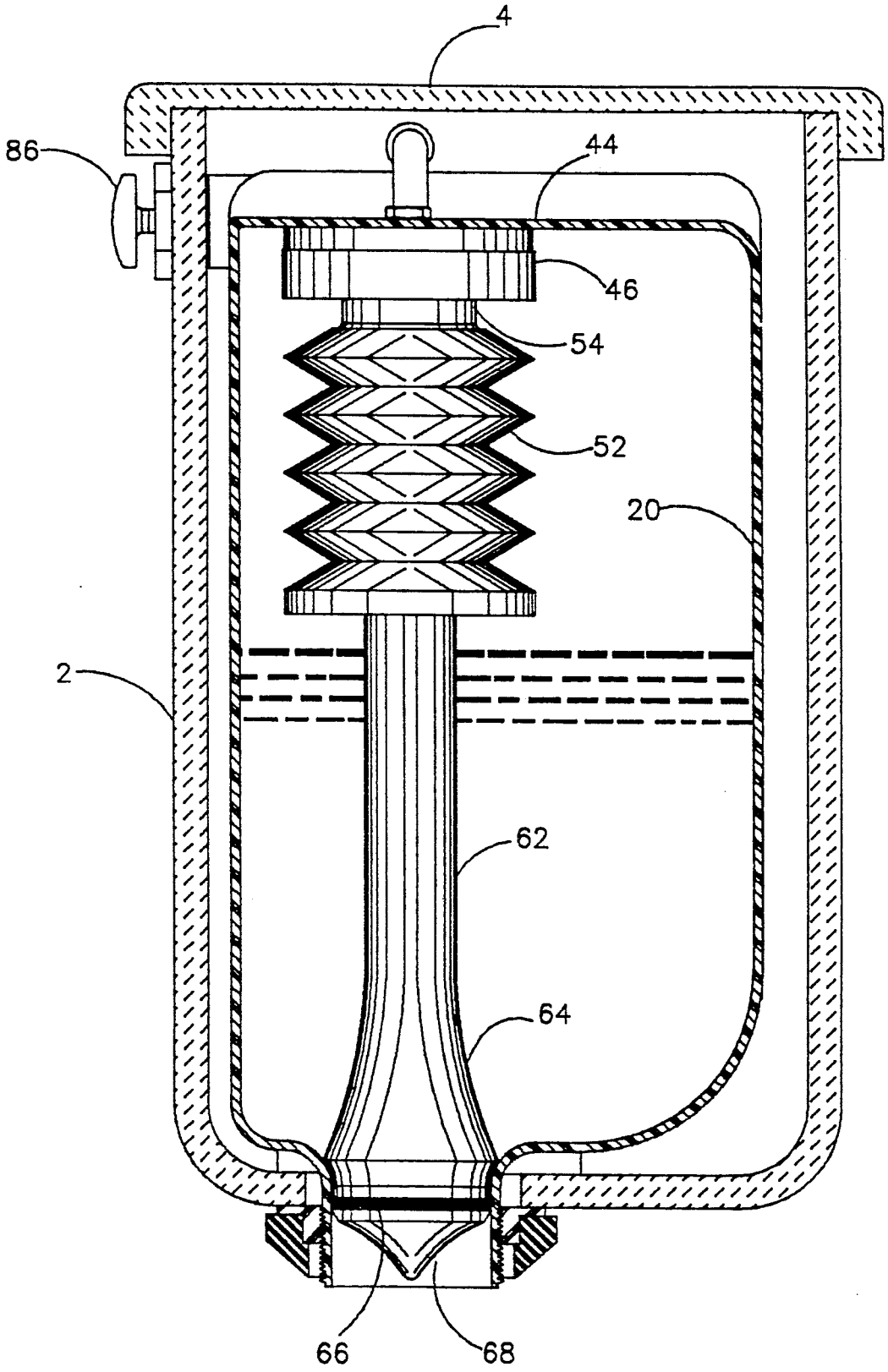
FIG. 4 is an enlarged partial cross sectional and side elevational view taken along line 4—4 of FIG. 1.
Figure 7:
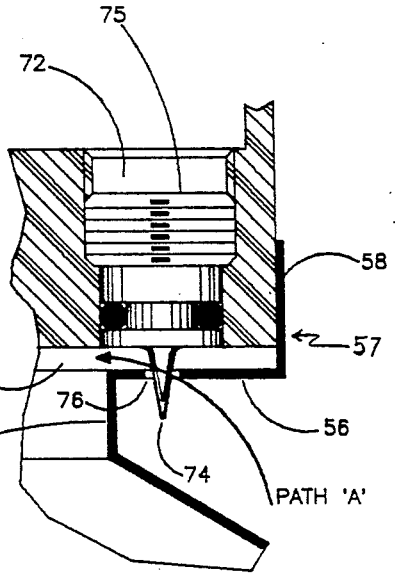
FIG. 7 is an enlarged view of the circled section shown in FIG. 6.
Figure 6:
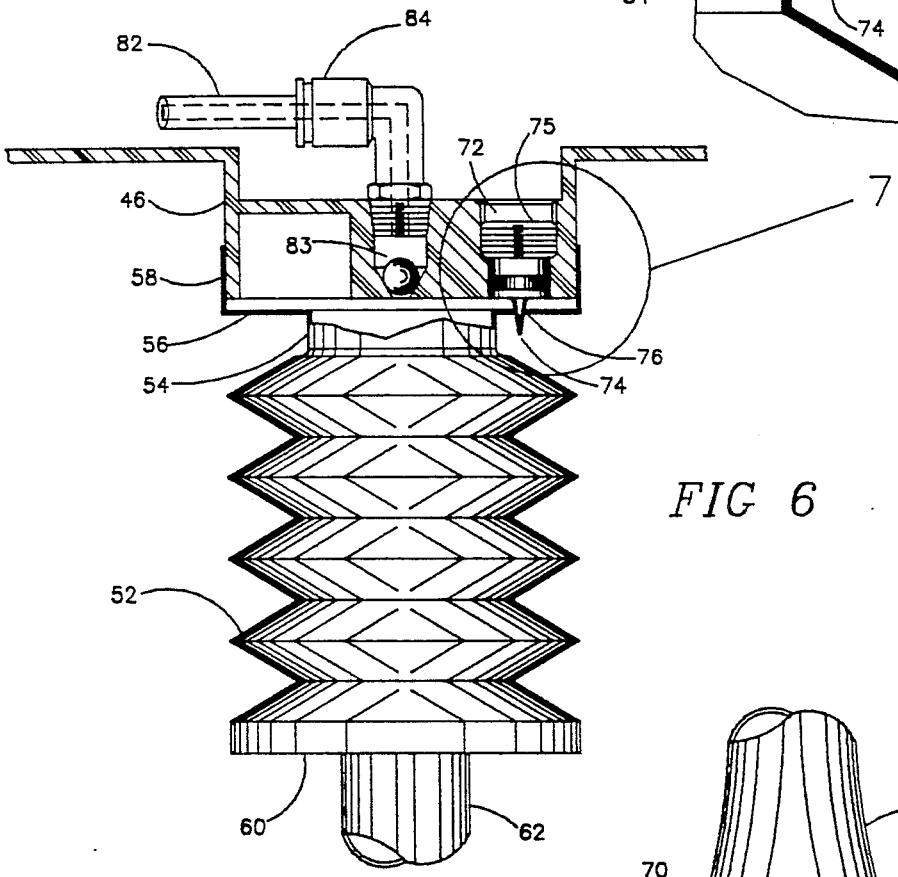
FIG. 6 is an enlarged view of the top most portion of the bellows shown in FIG. 1.
Figure 5:
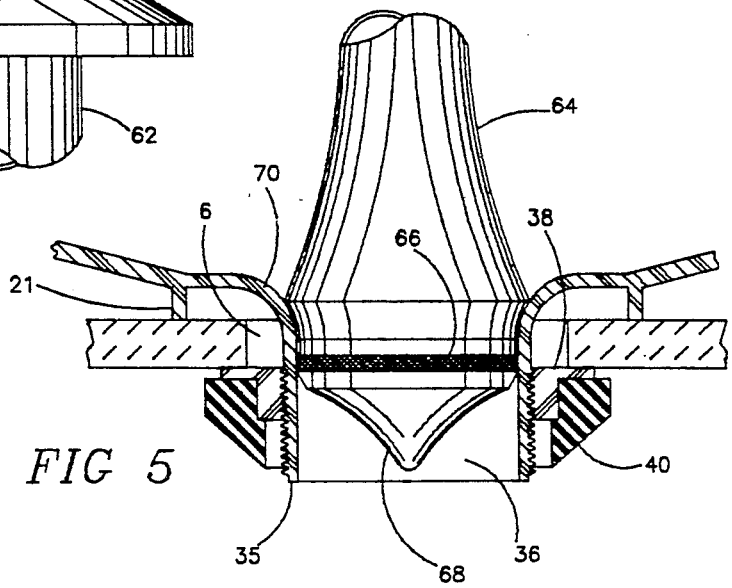
FIG. 5 is an enlarged view of the expanded end section of the plunger shown in FIG. 1.
Figure 8:
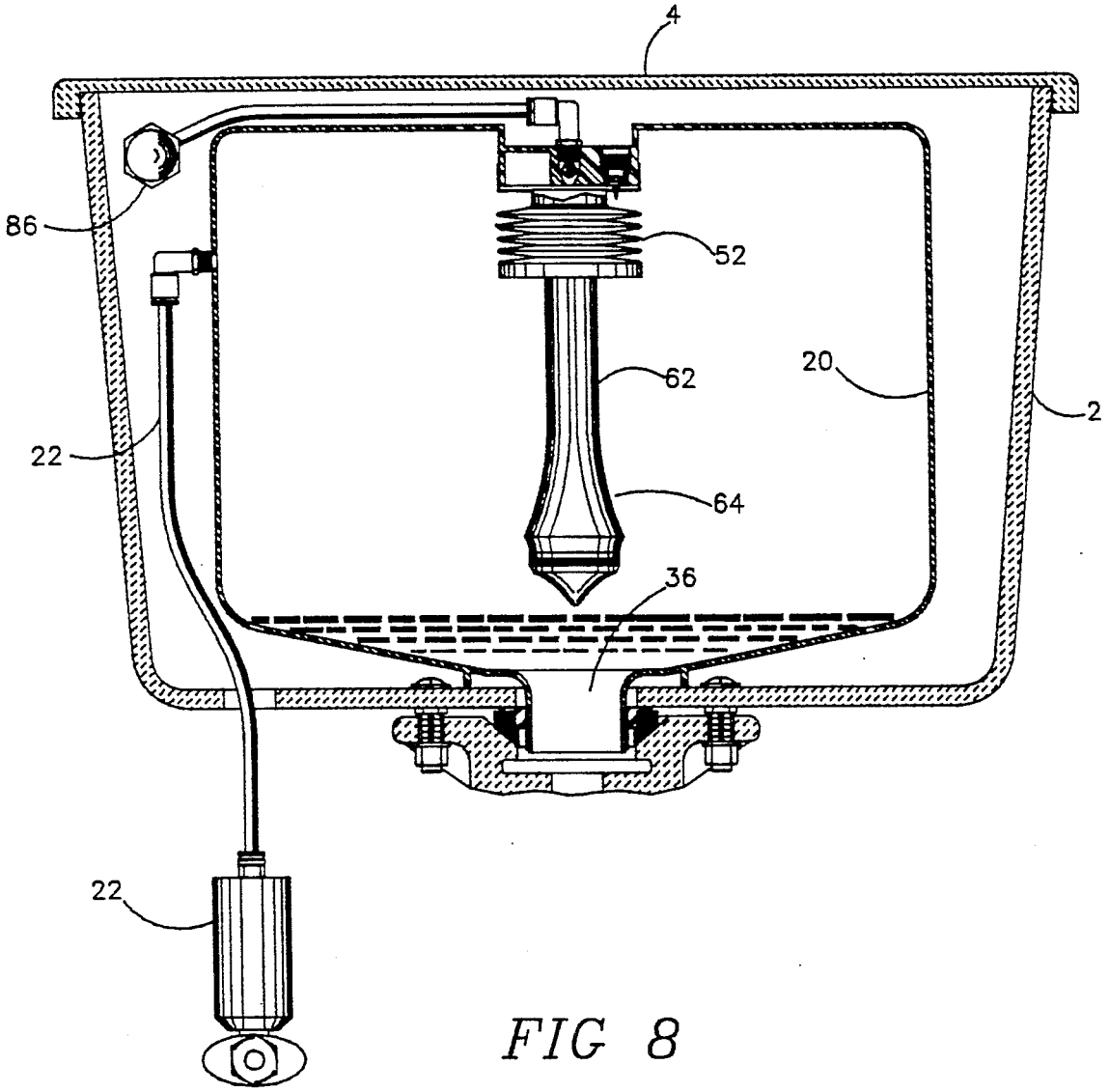
FIG. 8 is a partial cross sectional view and side elevation of the flushing system of this invention in its discharging state.

The apparatus and system illustrated in FIGS. 1 through 8 generally include a conventional gravity type commode water tank 2 currently in use in most: residential dwellings. The tank is enclosed by a removable cover 4 and at least three conventional apertures. A first threaded aperture 6 for allowing water to be discharged from the tank into a toilet bowl during the flushing process; a second sealable aperture 8 through which a pressurized inlet water line passes; :nd a third aperture 10 through which passes a lever for mechanically actuating the flushing process in a conventional commode. The above description is important only from the standpoint that the flushing system of this invention can be installed and operated using existing tanks and apertures. However, it should be evident that: the flushing unit of this invention can also be constructed and used independent of existing installations.

As shown in FIGS. 1 through 8, the flushing system of this invention includes a substantially pressurizeable rectangular shaped closed tank 20. For purposes of this disclosure, the tank is dimensioned so that it can be readily inserted in and used with existing commode tanks. One end of a water inlet line 22 is securely fixed in an aperture 23 bored in one of the side walls of the tank 20 and securely fixed thereto by a conventional elbow and coupling 24. The other end of the water line 22 is connected to a reducing water pressure regulator 26 capable of controlling the water pressure over a preselected range of about 6 psi to 10 psi. Normally, this system will be operated over a range of 8 psi to 15 psi and preferably about 11 psi. A shut-off valve 28 is normally included between the main water line 30 (FIG. 3) ant the regulator 26 to permit cleaning, repairing and installing this system.

The bottom of the tank 20 has an outter threaded open extension 35 to provide a water outlet 36. The threaded extension is designed and shaped to pass through the aperture 6 in an existing tank 2 and into a toilet bowl 37 (partially shown). Tank 20 is supported within the commode tank by a ring base 21 and, through its threaded extension, is securely held to the commode tank by a conventional nut 38. Conventional sealing 40 means and a pair of bolts and nuts 42 are provided to position and hold the tank 20 over the aperture 6 in the commode tank 2.

Extending downward from the top wall 44 is a circular depression forming a downward circular extension 46. A compressible or collapsible bellows 52 is securely fastened to the circular extension 46 by bonding or other fastening means. The bellows is constructed from a non-corrosive water resistant polymeric material having :sufficient flexibility and rigidity to permit the bellows to extend and retract by compression many thousands of times over a fifteen year period or longer, without cracking or weakening. Suitable materials include polyethylene, polypropylene, polyamides, and the like. The bellows 52 is constructed and designed such that an internal pressure chamber 53 is provided within the bellows 52. (See FIGS. 6 & 7).

The bellows 52 is bonded, glued or otherwise attached to the circular extension 46 through a circular reducing diameter means shown generally by the numeral 57. The reducing means has a top vertical section, a bottom vertical section and a middle horizontal section 58, 54 and 56 respectively. The top vertical section 58 has a diameter larger than its bottom vertical section so that it may be secured to the outside wall of extension 46. The two vertical sections are connected by the horizontal section and thereby form the diameter reducing means 57. The bottom vertical section 54 in turn has a smaller diameter for receiving and securing thereto a rigid neck member attached to the top of bellows 52. The primary purpose of the reducing means, besides connecting the bellows 52 to the extension 46, is to maintain a separation between the neck of the bellows 52 and the extension 46 and thereby create a channel whereby the internal chamber of the bellows is in unrestricted communication with the pressure zone of tank 20. See FIG. 7). Preferably the bellows, the neck and the reducing means are molded as one single piece. However, this is not essential.

The other end of the bellows contains a solid circular plate 60 to which is fixed an elongated plunger 62 having an expanded end section 64. This end section is contoured to sealably engage the threaded extension 35. To insure a water tight seal an "U"-cup seal 66 or any other sealing means for closing opening 36 when the bellows is extended (See FIG. 5) can be provided. It should be noted that tle bellows is constructed such that in its static state, the bellows is biased downwardly causing it to be normally in a fully extended position. This is critical as the tank 20 normally is holding some water. It is only during the flushing operation that the bellows is in its collapsed or folded state. To facilitate&e and insure proper closing of opening 36, the end of plunger 62 is downwardly tapered to form a point 68. This point functions as a guide means to insure that the "U"-cup seal ring will securely seat in the throat section 70 of opening 36.

The circular extension contains a first bored opening 72 adapted to receive and hold an adjustable needle valve 75. The needle valve can be adjusted to vary the size of a port 76 bored in the horizontal section 56 of the diameter reducing means by raising or lowering the needle valves pointed end section 74. When the adjustable needle valve is partially opened, a pressurized zone 80 in tank 20 (created by the pressurized water held within tank 20 at a preselected level) is in communication through port 76 with the pressurizeable internal chamber 53 carried within the bellows. This is depicted by the arrow path "A" in FIG. 7. The purpose of the needle valve is to control the rate at which the bellows will return to its fully extended position and thereby keep the outlet 36 opened for a time sufficient to permit water to pass through and fill the toilet bowl after a flushing operation. Through adjustment of the needle valve, the toilet bowl can be filled with a preselected volume of water as may be desired by the user or as may be required by the particular shape and size of the toilet bowl.

Adjacent to the needle valve is a pressure release line 82 connected at one end to the circular extension 46 and in communication with a threaded coupling 84 connected to a one way ball floating valve 83. The other end of line 82 is connected to a conventional spring loaded release mechanism 86, which, when depressed, will instantaneously reduce the pressure in the bellows' internal chamber 53 to substantially ambient pressure. When the pressure within the bellows is reduced, the bellows will collapse, causing the plug 62 to be raised and opening aperture 36. At this point in time, the water held in the container will be forced under pressure into the toilet bowl, causing a flushing action. After the flushing action has been completed and the button valve closed, water will continue to flow into container 20 and into the toilet bowl through opening 36 until the plug is reseated therein. This movement is, as previously indicated, is controlled by the size of the port established by the needle valve 72.

In operation, the pressurizeable container 20 is filled with water through line 22. Opening 36 is closed and as water is introduced into the container, a pressure zone 80 above the water level is created. The amount of water introduced into the container is controlled by a pressure regulator valve 26. If, for example, the pressure regulator valve is set for 11 psi, water shall continue to flow into the container until the pressure zone attains a pressure of 11 psi. At that point in time, the flow of water being introduced into the container is terminated. Under normal conditions, the container is designed to hold approximately 1.5 gallons of water at a pressure of 10 psi. If, for example, the pressure is increased or decreased, the amount of the water in the container will likewise proportionately increase or decrease. Therefore, the user can control the volume of water in the container, as well as the amount of pressure under which the water will be held. The flushing cycle is initiated by depressing the button 86 causing the pressure within the bellows' chamber to be reduced. This sudden decrease in pressure causes the bellows to collapse and thereby raising plug 62. Water held within the container is then forced under pressure through opening 36 and into the toilet bowl. As the water is being released, the bellows will begin expanding and eventually plug opening 36. The rate at the which the bellows will expand is controlled by the needle valve which limits the rate at which the air will pass from the pressure zone into the internal chamber of bellows. As long as the plug has not closed opening 36, water shall continue to flow through opening 36 and into the toilet bowl. This permits the user to control the amount of flow into the toilet bowl and eventually the amount of water to be retained in the bowl. The water in the bowl creates a water seal which prevents the escape of sewer gas and reduces the area of the toilet bowl which will not be covered by standing water.

I claim:

1. An apparatus for flushing commodes comprising:

a) a closed pressurizeable container having a water outlet;

b) means for introducing water under pressure into said container whereby a distinct water level and a pressure zone above said water level is established when water has been introduced into said container;

c) an extendable and retractable means mounted within said pressure zone, said means having an internal pressurizeable chamber;

d) a plug means connected to said extendable and retractable means for blocking said water outlet when said extendable and retractable means is fully extended;

e) a constrictable channel means in direct communication with said pressure zone and said internal chamber of said extendable and retractable means so that the pressure within said pressure zone and said inner chamber can be equalized over time;

f) a second means for releasing the pressure within said internal chamber and thereby causing said extendable and retractable means to retract and concomitantly to withdraw said plug from said water outlet and thereby permit said water to be released under pressure into a toilet bowl.

2. The apparatus of claim 1, including a means for regulating the pressure of the water introduced into said container.

3. The apparatus of claim 2 including a means for adjustably constricting said channel means.

4. The apparatus of claim wherein said means for constricting said channel means is a needle valve.

5. The apparatus of claim 4 wherein said needle valve is manually adjustable.

6. The apparatus of claim 5 wherein said second means for releasing said pressure within said internal chamber is an open close control means.

7. The apparatus of claim 6 wherein said control means includes a spring loaded button for actuating said control means and thereby open and close said control means.

8. The apparatus of claim 1 wherein said extendable and retractable first means is a hollow bellows.

9. The apparatus of claim 8 wherein said bellows is biased outwardly such that it is formally in a fully extended position.

10. The apparatus of claim 9 wherein said pressurizeable internal chamber is a zone located within said hollow bellows.

11. The apparatus of claim 10 wherein said channel means is a port connecting said pressure zone with said zone within said hollow bellows.

12. The apparatus of claim 11 wherein said port includes a means for restricting flow through said port.

13. The apparatus of claim 12, wherein said means for constricting said flow is a needle valve.

14. The apparatus of claim 1 wherein said apparatus is shaped and sized such that it may be placed in and used in existing gravity type flushing commode tanks.

15. The apparatus of claim 13 wherein the pressure in said pressure zone is less than 15 psi.

16. The apparatus of claim 15 wherein the volume of water introduced into said container is less than two gallons.

* * * * *